US007044891B1

(12) United States Patent
Rivera

(10) Patent No.: US 7,044,891 B1
(45) Date of Patent: May 16, 2006

(54) VIDEO BIKE

(76) Inventor: Juan Rivera, P.O. Box 72, Patillas, PR (US) 00723

( * ) Notice: Subject to any disclaimer, the term of this patent is extended or adjusted under 35 U.S.C. 154(b) by 0 days.

(21) Appl. No.: 10/944,952

(22) Filed: Sep. 20, 2004

(51) Int. Cl.
*A63B 21/00* (2006.01)

(52) U.S. Cl. ..... 482/8; 482/1; 482/9; 482/900

(58) Field of Classification Search ..... 482/1–9, 482/900–902; 348/730
See application file for complete search history.

(56) References Cited

U.S. PATENT DOCUMENTS 4,298,893 A * 11/1981 Holmes ..... 348/730
4,542,897 A 9/1985 Melton et al.
4,637,605 A 1/1987 Ritchien
5,142,358 A 8/1992 Jason
5,246,411 A 9/1993 Rackman et al.
5,456,648 A 10/1995 Edinburg et al.
5,462,503 A 10/1995 Benjamin et al.
5,524,637 A 6/1996 Erickson
5,888,172 A 3/1999 Andrus et al.
6,027,428 A * 2/2000 Thomas et al. ..... 482/4
6,179,746 B1 1/2001 Delman
6,244,988 B1 6/2001 Delman
6,450,922 B1 * 9/2002 Henderson et al. ..... 482/8

* cited by examiner

*Primary Examiner*—Glenn E. Richman
(74) *Attorney, Agent, or Firm*—Michael I Kroll

(57) ABSTRACT

An exercise cycle apparatus displays audio/visual data while in use. The apparatus includes means for displaying audio/visual data positioned at the handlebars of the cycle. A pedal mechanism generates rotational energy and energy converter is connected between the pedal mechanism and the audio/video display means. The energy converter converts the generated rotational energy into electrical energy and the electrical energy is provided to the audio/video display means for displaying the audio/video data thereon.

9 Claims, 8 Drawing Sheets

VIDEO BIKE

BACKGROUND OF THE INVENTION

1. Field of the Invention

The present invention relates generally to fitness equipment, and more specifically, to an exercise bicycle having a video screen for viewing pre-recorded programs thereon. The user is able to exercise using the stationary cycle viewing programming provided by a media player connected to the display screen. The pre-recorded programs preferably include video tours of at least one of countries, cities and states. The media player and video screen are selectively powered by the rotational energy created by the user pedaling the bicycle.

2. Description of the Prior Art

Numerous other fitness machines exist in the prior art. Typical of these are U.S. Pat. Nos. 4,298,893; 4,542,897; 4,637,605; 5,142,358; 5,246,411; 5,456,648; 5,462,503; 5,524,637; 5,888,172; 6,179,746; 6,244,988 and PCT Application 01/12269. While these fitness machines may be suitable for the purposes for which they were designed, they would not be as suitable for the purposes of the present invention, as hereinafter described.

U.S. Pat. No. 4,298,893

Inventor: Holmes

Issued: Nov. 3, 1981

A television set is energized by electricity generated by an exercise cycle. The bicycle may be used to charge a battery which in turn operates the T.V. set or the exercise cycle can turn a generator which directly operates the set. The device is particularly useful in limiting the amount of "junk" T.V. watched by children.

U.S. Pat. No. 5,246,411

Inventor: Rackman, et al.

Issued: Sep. 21, 1993

An exercise system and method for insuring that a user exercises at a level at or above a preset level. The user exercises in front of TV. Noise is mixed with the TV signal if the exercise level drops below the preset level. The result is instantaneous biofeedback and maintenance of the desired exercise level.

U.S. Pat. No. 5,888,172

Inventor: Andrus, et al.

Issued: Mar. 30, 1999

A physical exercise video system includes a physical exercise machine (22), a video system (24) and an interface module (26). The video system (24) has a computer (28) and a removable cartridge (34). The interface module (26) is interposed between the computer (28) and cartridge (34), and provides interactive communications between the computer (28) and exercise machine (22). A communication protocol governs this communication, and includes specifications for status and command data packets. The video system (24) and exercise machine (22) can be selectively operated as either stand-alone units, or in an interactive exercise mode, wherein the exercise data by the exercise machine (22) affects the output of the video system (24), and may also be stored in memory within the interface module (26). The video system (24) controls the operation of the exercise machine (22) generally, and specifically, controls the load resistance imposed in opposition to the movement of pedals (66). The control of load resistance by video system (24) is a function of the operating characteristics of the exercise machine (22).

U.S. Pat. No. 4,542,897

Inventor: Melton et al.

Issued: Sep. 24, 1985

An exercycle combined with a video game computer and game control allows the physical effort of the operator to generate electrical current for operation of the game control permitting the operator to control and interact with the computer upon maintaining a predetermined level of physical effort. Although the computer is activated by a separate power source, the generator, upon attainment of a predetermined energy expenditure level, activates the computer game. The apparatus provides amusement and an incentive to perform monotonous exercise routines as well as developing mental and manual coordination skills simultaneously with physical development.

U.S. Pat. No. 5,456,648

Inventor: Edinburg, et al.

Issued: Oct. 10, 1995

Method and apparatus for exercise in which a preselected work input to an exercise machine that is associated with an award-granting switch triggers a reward. The input can be a particular rate of work as measured by rotational speed or linear motion or a summation of the time during which a threshold level of work was exceeded. The reward can be turning on a TV or like electrical apparatus or it can be a change in the exercise machine and regime. An exercise machine incorporating the award-granting switch is disclosed in which the reward is a change in the angle to horizontal at which the exercise is performed. This change can make the exercise harder or easier depending on the exercise protocol desired.

U.S. Pat. No. 6,179,746

Inventor: Delman

Issued: Jan. 30, 2001

An activity controlled audio-visual system is disclosed. A device for connecting exercise equipment such as a pedal exerciser to a user sensory interface, such as a television set or computer so that the user has to pedal at a rate above a preset rate or threshold rate in order to be able to view the user sensory interface signal. The act of pedaling above a preset rate turns on a switch box which controls the input to the user sensory interface. In this way a normally sedentary activity such as watching television or a video, playing a video game, or using a computer is converted to one that requires physical activity.

U.S. Pat. No. 4,637,605

Inventor: Ritchie

Issued: Jan. 20, 1987

The present invention relates to a video game control arrangement in which player movement is controlled on a video screen from the handlebars of an exercise device such as a stationary exercise bicycle. The arrangement is set up such that the video controls can only be operated with a pre-set acceptable exercise level below which the controls are non-operational.

U.S. Pat. No. 5,462,503

Inventor: Benjamin, et al

Issued: Oct. 31, 1995

An interactive exercise apparatus engages a user's mind and body. The apparatus comprises a support structure for supporting a user. An exercise mechanism and a steering mechanism are proximal to the support structure. A simulated environment is generated by a computer and displayed on a display system. The user manipulates the exercise mechanism and the steering mechanism to freely navigate through the simulated environment. The computer monitors the exercise mechanism and the steering mechanism to determine user position in the simulated environment. The display is periodically updated by the computer to provide a continuous visual display of the user's position as the user travels through the simulated environment.

U.S. Pat. No. 6,244,988

Inventor: Delman

Issued: Jun. 12, 2001

An improved interactive exercise system is disclosed. A simplified device for connecting fitness equipment such as an exercise bicycle to a computer is equipped with a game control device (e.g. industry standard computers equipped with a joystick or game port adapter). The invention also includes a self-contained exercise device. The act of exercising is converted into signals by a sensor which are then counted by the software and used to control an audio-visual display in such a way that pedaling speed can control the speed of what is been viewed. Hand operated switches allow the user to chose directions when the display indicates the user has come to a turning point. Various exercise parameters and progress towards goals are shown in a window on the display. Parameters and exercise data can be stored, reviewed, and used during other sessions. When used as an interactive exercise touring system, the user can literally pedal his way around the world, through the universe, or even through the human body, seeing the sights on the display screen and listening to a narrator describe what is being seen. By depressing the appropriate touch switches, the user can retrieve more information about a particular area and has the ability to pause the presentation at any time independent of the exercise activity. The device is linkable to other devices so that multiple users can tour a place together or compete against each other.

U.S. Pat. No. 5,142,358

Inventor: Jason

Issued: Aug. 25, 1992

An earn per view device affording variable viewing on a television as a reward for accomplishment of a positive task on an exercise machine, computer, electronic glove or other associated device. A tabulation and accumulation device tabulates and accumulates the amount of positive task performed on the associated positive task device. A control device for controlling the access to viewing on the associated video device in electrical communication with the tabulation and accumulation device. The control device may be activated the user to afford viewing on the television in proportion to the quantity of positive task accumulated by the tabulation and accumulation device.

U.S. Pat. No. 5,524,637

Inventor: Erickson

Issued: Jun. 11, 1996

A system is provided for monitoring the physiological exertion of a user. One or more sensors are attached to the limbs of the user to measure the user's motion. The sensors can measure either the acceleration or the force on the limbs. The measured signal is transmitted to a monitor by a wireless transmitter, such as an infrared, acoustic or radio transmitter. The monitor determines and displays the level of physiological exertion of the user by a mathematical formula or a look up table based on the measured motion of the user. The system can also measure and display various other physiological parameters of the user, such as pulse rate, blood pressure, etc. The system includes an interactive video display with a branching video sequence. The rate of progress and the direction of the video sequence at each of the branching points are interactively controlled by the level of physiological exertion and the movements of the user. The system can also record and display the level of physiological exertion and other physiological parameters of the user over time to create a personal exercise log.

European Patent Number WO0112269

Inventor: Pyles

Issued: Feb. 22, 2001

The invention relates to a modular fitness device consisting of a stationary fitness device with a video display mounted thereon, an electronic media interface and an exercise sensor. The interface enables connection of the display to one or more of a variety of electronic media, including PC, video/audio recorder, set top box, games console etc. Preferably, a connection to the internet can be provided. User interfaces for control of the device can include a combination of voice-activation, a touch mouse pad or a keyboard movably attached to the device.

SUMMARY OF THE PRESENT INVENTION

The present invention relates generally to fitness equipment, and more specifically, to an exercise bicycle having a video screen for viewing pre-recorded programs thereon.

The user is able to exercise using the stationary cycle viewing programming provided by a media player connected to the display screen. The pre-recorded programs preferably include video tours of at least one of countries, cities and states. The media player and video screen are selectively powered by the rotational energy created by the user pedaling the bicycle.

A primary object of the present invention is to provide a video bike that overcomes the shortcomings of the prior art.

Another object of the present invention is to provide a video bike that is formed as an exercise cycle.

Still another object of the present invention is to provide a video bike having video means connected to the handlebars thereof.

Still another object of the present invention is to provide a video bike wherein the video means includes a media reader and a display screen.

Yet another object of the present invention is to provide a video bike wherein the display screen is at least one of an LCD and a plasma screen.

Still yet another object of the present invention is to provide a video bike wherein the media reader is a DVD player.

A further object of the present invention is to provide a video bike wherein the media read by the media reader contains pre-recorded programs of an entertaining and educational nature.

Another object of the present invention is to provide a video bike including a power circuit for providing power to the video means.

Yet another object of the present invention is to provide a video bike wherein the power circuit includes an energy converter for converting the rotational energy generated by the user into electrical energy.

Still another object of the present invention is to provide a video bike including a processor connected to a ROM having pre-determined workout routines stored therein.

Another object of the present invention is to provide a video bike wherein the pre-recorded programs correspond to the pre-stored workout routines.

An even further object of the present invention is to provide a video bike having a first sensor connected to the pedal mechanism for sensing the progress of the workout.

Yet a further object of the present invention is to provide a video bike wherein upon a user not keeping up with the workout, the sensor directs the processor to change the video viewed by the viewer to one which is better suited to the users workout level.

Another object of the present invention is to provide a video bike having a second sensor connected between the processor and the power source for selectively monitoring the power level.

Still a further object of the present invention is to provide a video bike wherein upon the second sensor determining the power level is below a threshold value, the second sensor directs the processor to change at least one of the workout routine and the video being viewed to one that increases the rotational energy produced by the pedaling mechanism.

Yet another object of the present invention is to provide a video bike that is simple and easy to use.

Still yet another object of the present invention is to provide a video bike that is inexpensive to manufacture and operate.

Additional objects of the present invention will appear as the description proceeds.

The foregoing and other objects and advantages will appear from the description to follow. In the description reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
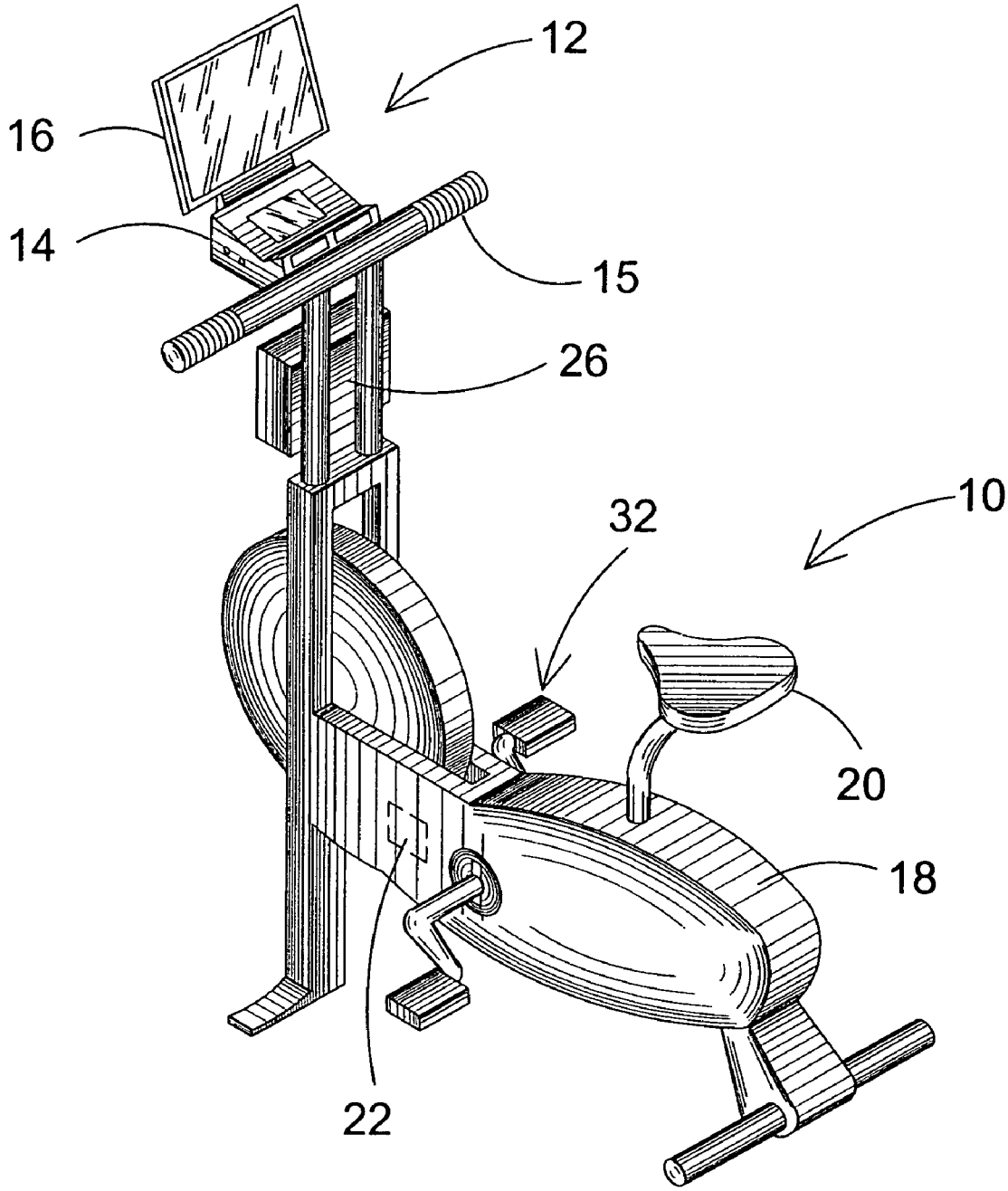
FIG. 1 is a perspective view of the video bike of the present invention.

Turning now descriptively to the drawings, in which similar reference characters denote similar elements throughout the several views, the Figures illustrate the video bike of the present invention. With regard to the reference numerals used, the following numbering is used throughout the various drawing Figures.

10 video bike of the present invention
12 video means
14 media reader
15 handlebar
16 screen
18 body
20 seat
22 power circuit
24 headphones
26 media storage
28 slot
30 energy converter
32 pedal mechanism
34 processor
36 first sensor
38 second sensor
40 ROM

DETAILED DESCRIPTION OF THE PREFERRED EMBODIMENT

The following discussion describes in detail one embodiment of the invention. This discussion should not be construed, however, as limiting the invention to those particular embodiments. Practitioners skilled in the art will recognize numerous other embodiments as well. For definition of the complete scope of the invention, the reader is directed to appended claims.

Turning now descriptively to the drawings, in which similar reference characters denote similar elements throughout the several views, FIGS. 1 through 8 illustrate the video bike of the present invention indicated generally by the numeral 10.

FIG. 1 is a perspective view of the video bike of the present invention. The video bike 10 of the present invention includes a conventional exercise bike having a video means 12 connected thereto for view of video data while the bike 10 is in use. The bike includes a body 18 having handlebars 15 extending upward at a first end thereof. Also extending from the body 18 of the bike is a seat 20 and a pedal mechanism 32. The video bike 10 also includes a power circuit 22 connected to the pedal mechanism and positioned within the body 18.

The video means includes a media reader 14 and a display screen 16. The media reader 14 is able to read a plurality of different media formats. For example, the media reader 14 may include at least one of a video CD player, a DVD player, a VHS player, a compact flash card view, a secure digital card viewer, a memory stick viewer and a smart media card viewer. The above described media readers are mentioned for purposes of example only and the media reader 14 is able to read any type of media that has video data stored thereon.

The video means 12 is preferably positioned adjacent to the handlebars 15 thereby providing a natural viewing angle to a user of the video bike 10. As the user pedals the pedal mechanism rotational energy is created by the pedaling motion. This rotational energy is converted into electrical energy within the power circuit 22. The electrical energy is then used to provide power to the video means 12 of the present invention. The user can selectively insert media having video data stored thereon into the media reader 14. Since the video means 12 is powered by the power circuit 22 connected thereto, the user is able to view the video data on the screen 16 as the user continues the workout.

Figure 2:
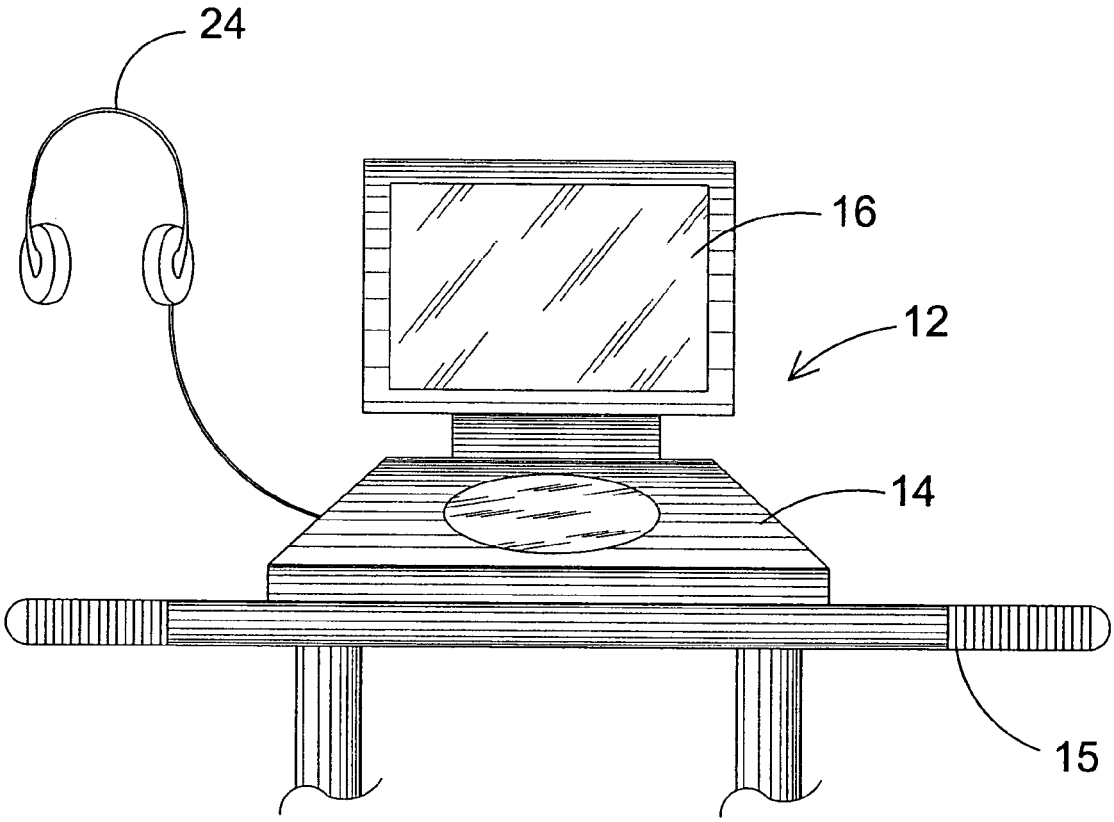
FIG. 2 is a front view of the video means of the video bike of the present invention.

FIG. 2 is a front view of the video means of the video bike of the present invention. The video bike 10 of the present invention includes a conventional exercise bike having a video means 12 connected thereto for view of video data while the bike 10 is in use. The bike includes a body 18 having handlebars 15 extending upward at a first end thereof. Also extending from the body 18 of the bike is a seat 20 and a pedal mechanism 32. The video bike 10 also includes a power circuit 22 connected to the pedal mechanism and positioned within the body 18.

The video means includes a media reader 14 and a display screen 16. The media reader 14 is able to read a plurality of different media formats. For example, the media reader 14 may include at least one of a video CD player, a DVD player, a VHS player, a compact flash card view, a secure digital card viewer, a memory stick viewer and a smart media card viewer. The above described media readers are mentioned for purposes of example only and the media reader 14 is able to read any type of media that has video data stored thereon.

The video means 12 is preferably positioned adjacent to the handlebars 15 thereby providing a natural viewing angle to a user of the video bike 10. As the user pedals the pedal mechanism rotational energy is created by the pedaling motion. This rotational energy is converted into electrical energy within the power circuit 22. The electrical energy is then used to provide power to the video means 12 of the present invention. The user can selectively insert media having video data stored thereon into the media reader 14. Since the video means 12 is powered by the power circuit 22 connected thereto, the user is able to view the video data on the screen 16 as the user continues the workout. As shown herein, the video means includes headphones 24 for output of any audio data that is associated with the video data stored on the media being read by the media reader 14.

Figure 3:
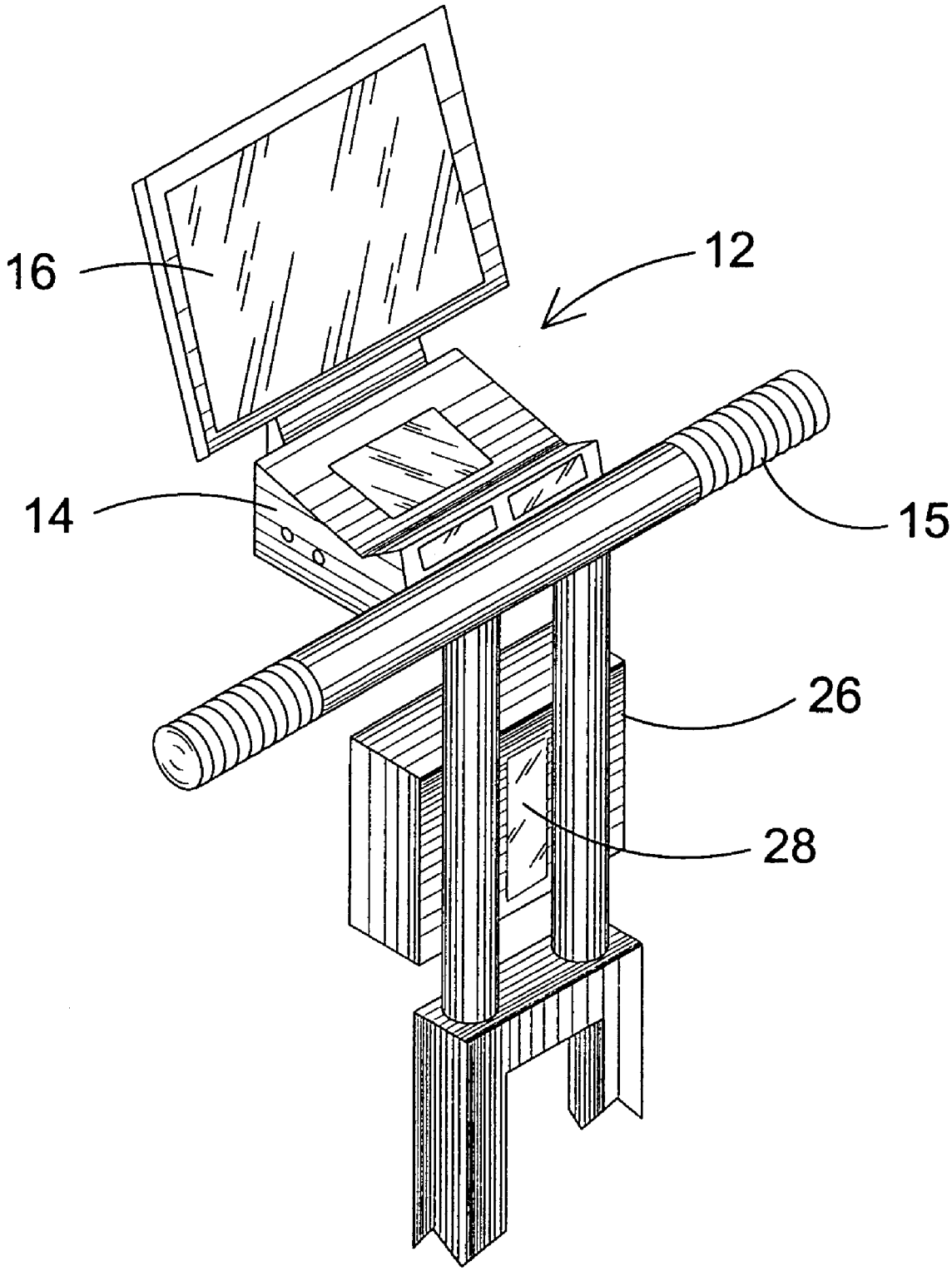
FIG. 3 is a perspective view of the video means of the video bike of the present invention.

FIG. 3 is a perspective view of the video means of the video bike of the present invention. The video bike 10 of the present invention includes a conventional exercise bike having a video means 12 connected thereto for view of video data while the bike 10 is in use. The bike includes a body 18 having handlebars 15 extending upward at a first end thereof. Also extending from the body 18 of the bike is a seat 20 and a pedal mechanism 32. The video bike 10 also includes a power circuit 22 connected to the pedal mechanism and positioned within the body 18.

The video means includes a media reader 14 and a display screen 16. The media reader 14 is able to read a plurality of different media formats. For example, the media reader 14 may include at least one of a video CD player, a DVD player, a VHS player, a compact flash card view, a secure digital card viewer, a memory stick viewer and a smart media card viewer. The above described media readers are mentioned for purposes of example only and the media reader 14 is able to read any type of media that has video data stored thereon.

The video means 12 is preferably positioned adjacent to the handlebars 15 thereby providing a natural viewing angle to a user of the video bike 10. As the user pedals the pedal mechanism rotational energy is created by the pedaling motion. This rotational energy is converted into electrical energy within the power circuit 22. The electrical energy is then used to provide power to the video means 12 of the present invention. The user can selectively insert media having video data stored thereon into the media reader 14. Since the video means 12 is powered by the power circuit 22 connected thereto, the user is able to view the video data on the screen 16 as the user continues the workout.

Additionally, the video bike 10 of the present invention includes a media storage container 26 connected to a handlebar support bar. The media storage container includes a slot 28 for receiving portable media therein as well as removing media therefrom. The slot 28 is positioned on a side of the container 26 closest the rider of the video bike 10. The user can selectively change the media being read by the reader 14 without disturbing his/her workout by easily removing the new media from the storage container 26 and replacing the old media therein.

Figure 4:
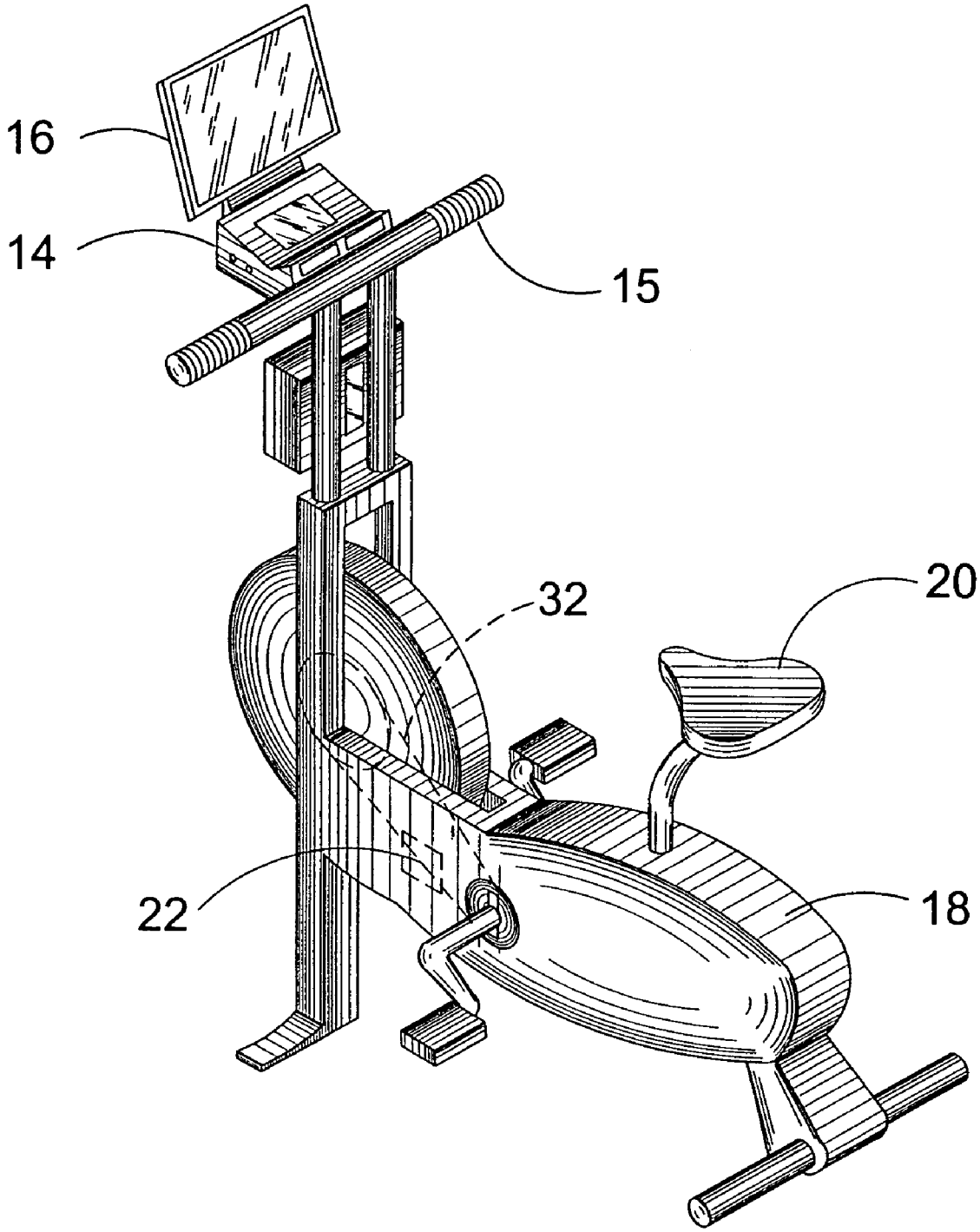
FIG. 4 is side cutout view of the video bike of the present invention.

FIG. 4 is side cutout view of the video bike of the present invention. The video bike 10 of the present invention includes a conventional exercise bike having a video means 12 connected thereto for view of video data while the bike 10 is in use. The bike includes a body 18 having handlebars 15 extending upward at a first end thereof. Also extending from the body 18 of the bike is a seat 20 and a pedal mechanism 32. The video bike 10 also includes a power circuit 22 connected to the pedal mechanism and positioned within the body 18.

The video means includes a media reader 14 and a display screen 16. The media reader 14 is able to read a plurality of different media formats. For example, the media reader 14 may include at least one of a video CD player, a DVD player, a VHS player, a compact flash card view, a secure digital card viewer, a memory stick viewer and a smart media card viewer. The above described media readers are mentioned for purposes of example only and the media reader 14 is able to read any type of media that has video data stored thereon.

The video means 12 is preferably positioned adjacent to the handlebars 15 thereby providing a natural viewing angle to a user of the video bike 10. As the user pedals the pedal mechanism rotational energy is created by the pedaling motion. This rotational energy is converted into electrical energy within the power circuit 22. The electrical energy is then used to provide power to the video means 12 of the present invention. The user can selectively insert media having video data stored thereon into the media reader 14. Since the video means 12 is powered by the power circuit 22 connected thereto, the user is able to view the video data on the screen 16 as the user continues the workout.

Additionally, the video bike 10 of the present invention includes a media storage container 26 connected to a handlebar support bar. The media storage container includes a slot 28 for receiving portable media therein as well as removing media therefrom. The slot 28 is positioned on a side of the container 26 closest the rider of the video bike 10. The user can selectively change the media being read by the reader 14 without disturbing his/her workout by easily removing the new media from the storage container 26 and replacing the old media therein.

Figure 5:
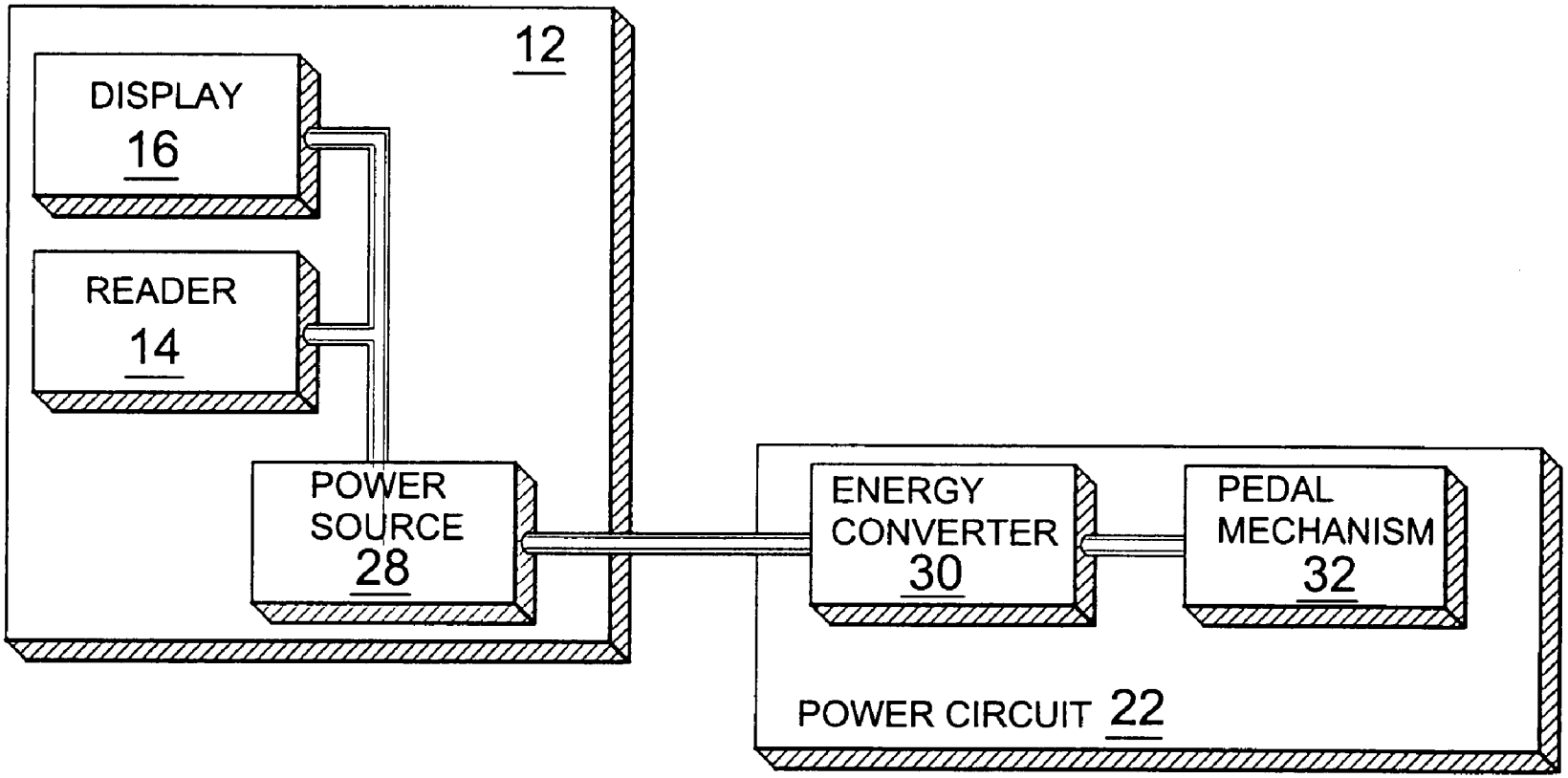
FIG. 5 is a block diagram of the video bike of the present invention.

FIG. 5 is a block diagram of the video bike of the present invention. The video bike 10 of the present invention includes the video means 12. The video means 12 includes the media reader 14 for reading media having audio/video data stored thereon and a display screen 16 for displaying the stored audio/video data. The video means is powered by a power source 28. Preferably, the power source is a rechargeable power source. The power source 28 receives power from the power circuit 22. The power circuit 22 includes the pedal mechanism 32 and an energy converter 30.

Upon a user mounting the seat 20 of the bike 10, as shown in FIG. 1, the user engages the pedal mechanism 32 to begin the workout. As the user causes the pedals of the pedal mechanism 32 to rotate, rotational energy is generated thereby. The energy converter 30 of the power circuit 22 converts the rotational energy in a known manner into electrical energy. Upon this conversion being complete, the electrical energy is provided to the power source 28 of the video means 12. The power source then is able to utilize the energy to operate the media reader 14 and display the audio/video data on the display 16. Additionally, the power source is able to charge a power reserve so that power can be provided to the video means even when the user is not pedaling or is not pedaling at a rate sufficient to generate enough rotational energy to be converted into electrical energy.

Figure 6:
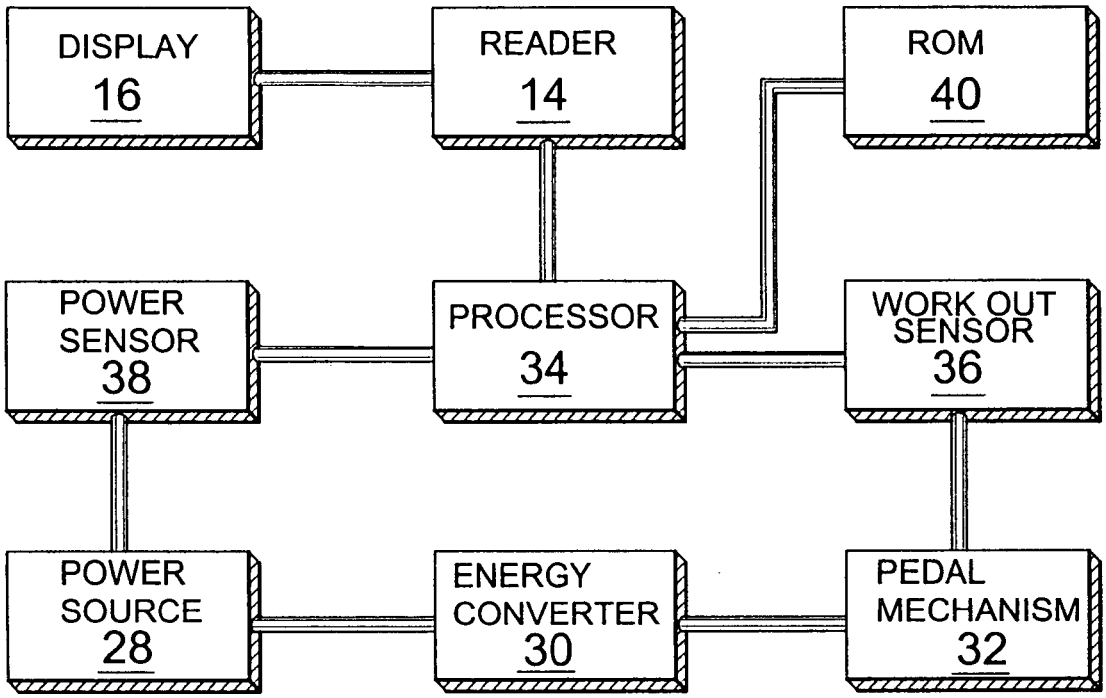
FIG. 6 is a block diagram of an alternate embodiment of the video bike of the present invention.

FIG. 6 is a block diagram of an alternate embodiment of the video bike of the present invention. The video bike 10 of the present invention includes a processor 34. The reader 14 and display 16 are connected to the processor 34. A ROM 40 having pre-determined workout routines stored therein is also connected to the processor 34. A first sensor for sensing the progress of the running pre-determined workout routine is also connected to the processor 34. This first sensor is also connected to the pedal mechanism 32. Similarly as described above with respect to FIG. 5, the energy converter is connected between the power source 28 and the pedal mechanism 32. However, also connected to the power source is a second sensor 38 for sensing a power level of the video bike. This second sensor is also connected to the processor 34.

Upon a user not keeping up with the workout, the first sensor 36 directs the processor 34 to change the video being displayed on the screen 16 to a s video that better corresponds to a users workout level. If the second sensor 38 determines the power level is below a threshold value, the second sensor 38 directs the processor 34 to change at least one of the workout routine and the video being viewed to one that motivates the user to increase the rotational energy produced by the pedaling mechanism 32 by pedaling at a faster rate.

Figure 7:
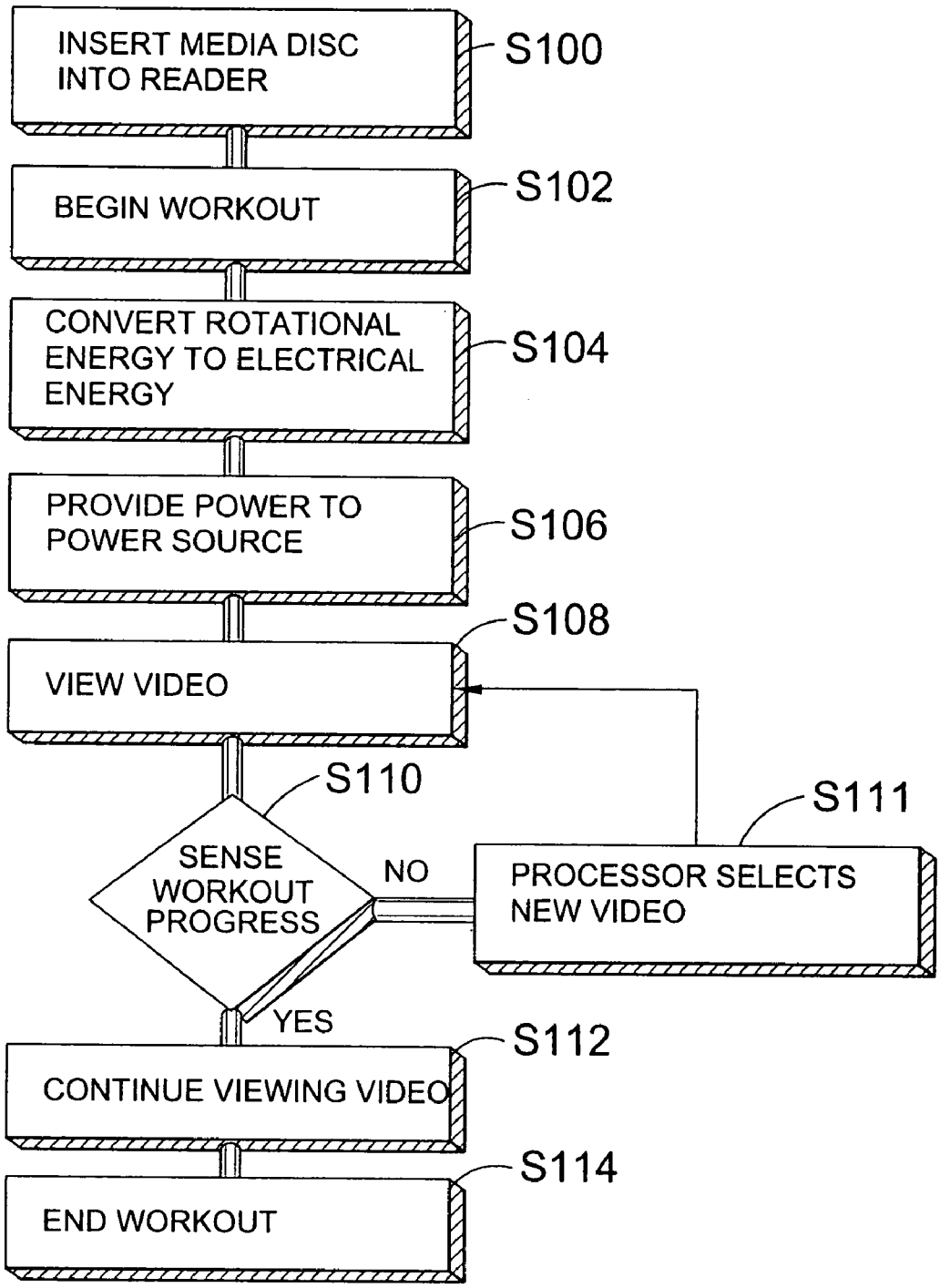
FIG. 7 is a flowchart detailing the operation of the video bike of the present invention.

FIG. 7 is a flowchart detailing the operation of the video bike of the present invention. Prior to operation of the video bike 10 of the present invention, the user must selectively determine which media disc contains the video program he/she would like to view during the workout. Upon selecting a media disc, the disc is inserted into the media reader 14 as shown in step S100. Thereafter, the user begins the workout as shown in step S102. As the workout progresses, the user pedals the pedal mechanism 32 and generates rotational energy which is converted, in step S104 to electrical energy. The electrical energy is then provided by the power circuit 22 to the power source 28 as shown in step S106. This process continues in step S108 which shows the user continuing to view the video. The first sensor 36 is activated in step S110 and senses the workout progress. If the user is progressing at an acceptable rate then the user continues viewing the video in step S112 until the workout is complete in step S114. However, is the sensor 36 detects that the user is not proceeding at an acceptable rate, the sensor 36 directs the processor 34 to select a new video as shown in step S111. The new selected video is preferably one that corresponds to the level of the user. After the new video is selected, the user then views the video as shown in step S108. Thereafter, the sensor 36 senses in step S110 until it is determined that the user is proceeding at an acceptable rate to continue viewing the video currently being displayed until the end of the workout in step S114.

Figure 8:
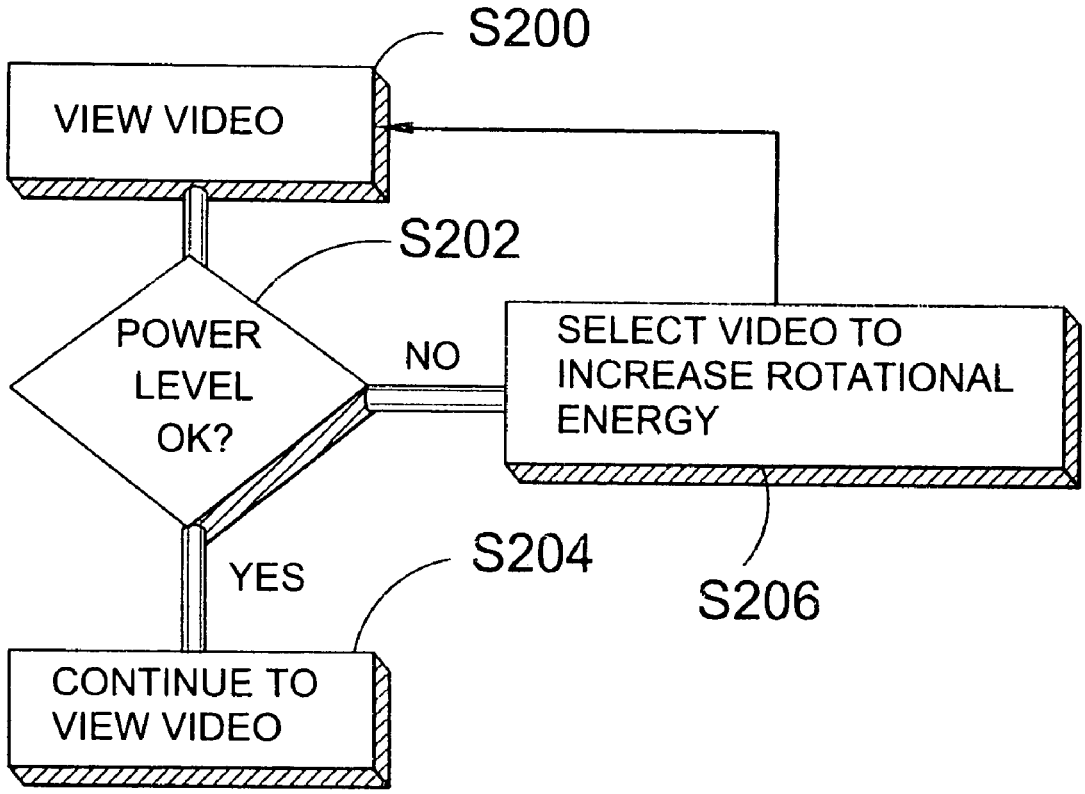
FIG. 8 is a flowchart of the power sensor of the video bike of the present claimed invention.

FIG. 8 is a flowchart of the power sensor of the video bike of the present claimed invention. The user is able to view the selected video as shown in step S200. The second sensor 38 is able to selectively determine is sufficient power is being provided by the power circuit 22 to the power source 28 of the video means. If the power sensor determines that the power level is above a threshold value then the user continues viewing the video as shown in step S204. However, if the power sensor 38 determines that the power level is below a threshold value, the power sensor 38 directs the processor to change the video being displayed to one that will likely motivate the user to increase the generated rotational energy as shown in step S206. Upon selecting a new video, the user is able to view the video in step S200.

The sensors described in FIGS. 7 and 8 operate simultaneously with one another in order to ensure proper operation of the video bike 10 of the present invention.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An exercise cycle apparatus for displaying audio/visual data while in use, said apparatus comprising:

a) means for displaying audio/visual data positioned at the handlebars of said cycle;

b) a pedal mechanism for generating rotational energy;

c) energy converter connected between said pedal mechanism and said audio/video display means, wherein said energy converter converts said generated rotational energy into electrical energy and said electrical energy is provided to said audio/video display means for displaying said audio/video data thereon, and d) a processor and a Read Only Memory connected to said processor, said ROM includes operation instructions for said cycle and, wherein said operation instructions include pre-stored workout routines wherein each respective one of said pre-stored workout routines corresponds to a unique set of said audio/video data and wherein each respective one of said pre-stored workouts has an known level of rotational energy associated therewith.

2. The apparatus as recited in claim 1, wherein said audio/video display means includes a media reader for reading audio/video data stored on removeable media and a display screen connected to said media reader for displaying said stored audio/video data thereon.

3. The apparatus as recited in claim 2, wherein said audio/video display means further includes a power source, said power source is coupled to said energy converter for receiving power therefrom and storing power therein.

4. The apparatus as recited in claim 2, wherein said media reader is at least one of a CD-ROM, DVD-ROM, VHS player and a memory card reader able to read a plurality of memory card formats.

5. The apparatus as recited in claim 1, further including a first sensor connected between said processor and said pedal mechanism, wherein said first sensor determines if said generated rotational energy is below said known level of rotational energy and upon said generated rotational energy being below said known level, said first processor directs said processor to select an alternate set of audio/video data.

6. The apparatus as recited in claim 1, further comprising a second sensor connected between said power source and said processor, wherein said second sensor determines if a power level contained in said power source is below a threshold value.

7. The apparatus as recited in claim 6, wherein upon said power level being below said threshold value, said second sensor directs said processor to select an alternate set of audio/video data for display on said audio/video display means.

8. The apparatus as recited in claim 7, wherein said selected alternate set of audio/video data is motivational audio/video data for motivating a user to increase an amount of said generated rotational energy.

9. The apparatus as recited in claim 1, further comprising a media storage unit positioned on a body of said cycle for selectively storing removeable media therein.

* * * * *